US011925828B2

(12) United States Patent
Inniss

(10) Patent No.: US 11,925,828 B2
(45) Date of Patent: Mar. 12, 2024

(54) DUMBELL CLIP DEVICE

(71) Applicant: Dennis Inniss, Scarborough (CA)

(72) Inventor: Dennis Inniss, Scarborough (CA)

( * ) Notice: Subject to any disclaimer, the term of this patent is extended or adjusted under 35 U.S.C. 154(b) by 155 days.

(21) Appl. No.: 17/843,299

(22) Filed: Jun. 17, 2022

(65) Prior Publication Data

US 2023/0405391 A1 Dec. 21, 2023

(51) Int. Cl.
*A63B 21/00* (2006.01)
*A63B 21/065* (2006.01)
*A63B 21/072* (2006.01)

(52) U.S. Cl.
CPC ..... *A63B 21/4009* (2015.10); *A63B 21/065* (2013.01); *A63B 21/0726* (2013.01)

(58) Field of Classification Search
CPC ..... A63B 21/4009; A63B 21/065; A63B 21/0726; E05D 15/0634; E05D 15/0652; E05D 15/0647; E05D 15/0686
See application file for complete search history.

(56) References Cited

U.S. PATENT DOCUMENTS 234,799 A * 11/1880 Neely ..... F16L 55/172 285/373
D329,748 S 9/1992 Ehlin
5,259,690 A * 11/1993 Legge ..... E04G 7/14 24/270
5,997,494 A 12/1999 Watkins
6,715,728 B2 4/2004 Nielsen
7,081,071 B2 * 7/2006 Smith ..... A63B 21/065 482/148
7,520,844 B1 * 4/2009 Flynn ..... A63B 21/065 482/108
7,789,814 B1 * 9/2010 Xu ..... A63B 21/0728 482/93
11,529,541 B1 * 12/2022 Inniss ..... A63B 21/0726
2005/0065000 A1 * 3/2005 Reinhart ..... A63B 21/4009 482/105
2010/0062911 A1 * 3/2010 Stone ..... A63B 21/065 482/92
2014/0194259 A1 * 7/2014 Alpert ..... A63B 21/065 482/105

FOREIGN PATENT DOCUMENTS

GB 2175511 5/1985

* cited by examiner

*Primary Examiner* — Andrew S Lo
*Assistant Examiner* — Andrew M Kobylarz

(57) ABSTRACT

A dumbbell clip device secures a dumbbell to a weight lifting belt. The device includes a conduit extending through a base. The conduit receives a weight lifting belt through the conduit to couple the base to the weight lifting belt. A bottom jaw extends from the base a fixed position on the base. A top jaw is pivotally coupled to the bottom jaw. An engagement is coupled to the base and has a locking edge is positioned to engage a tooth on the top jaw. The top jaw is secured in a closed position forming a closed loop with the bottom jaw for engaging and holding a dumbbell on the weight lifting belt.

15 Claims, 9 Drawing Sheets

DUMBELL CLIP DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to clip devices and more particularly pertains to a new clip device for securing a dumbbell to a weight lifting belt.

(2) Description of Related Art Including Information Disclosed Under 37 CFR 1.97 and 1.98

The prior art relates to clip devices. Known art generally provides for clamping to a bar but lacks engagement to a weight lifting belt for securely holding a dumbbell on the weight lifting belt.

BRIEF SUMMARY OF THE INVENTION

An embodiment of the disclosure meets the needs presented above by generally comprising a conduit extending through a base. The conduit receives a weight lifting belt through the conduit to couple the base to the weight lifting belt. A bottom jaw extends from the base a fixed position on the base. A top jaw is pivotally coupled to the bottom jaw. An engagement is coupled to the base and has a locking edge is positioned to engage a tooth on the top jaw. The top jaw is secured in a closed position forming a closed loop with the bottom jaw for engaging and holding a dumbbell on the weight lifting belt.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
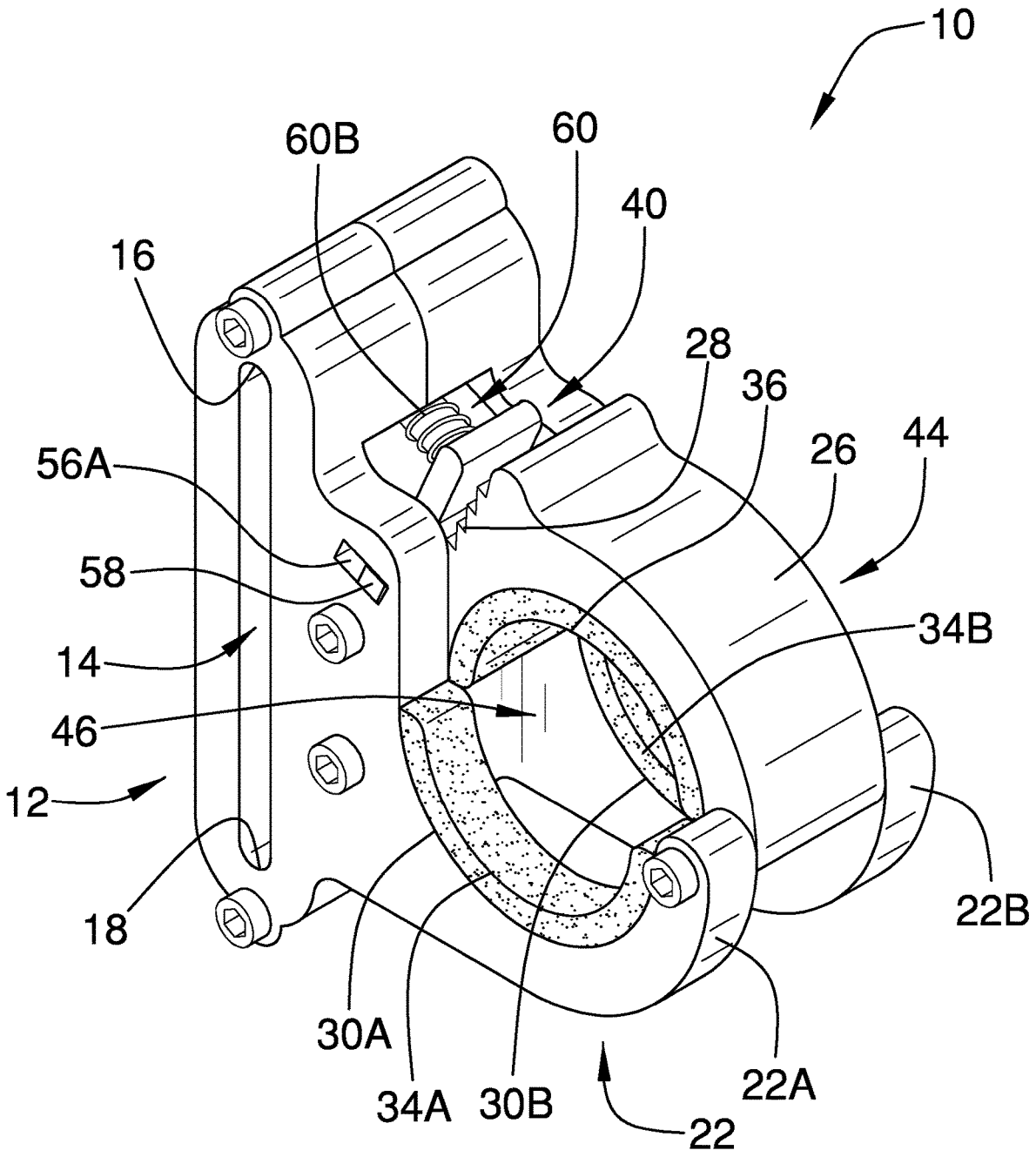
FIG. 1 is a top front side perspective view of a dumbbell clip device according to an embodiment of the disclosure.
Figure 2:
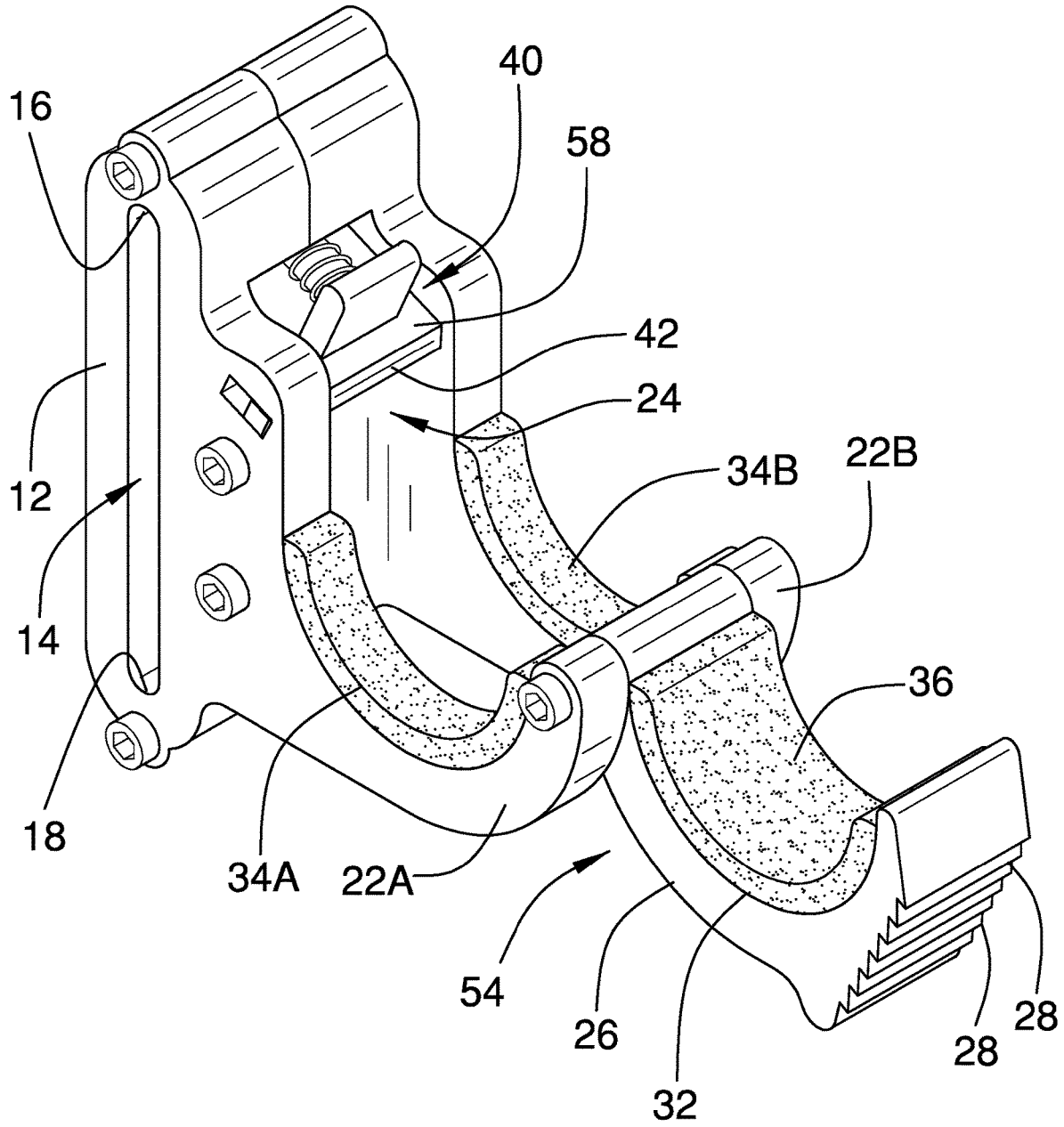
FIG. 2 is a top front side perspective view of an embodiment of the disclosure in an open position.
Figure 3:
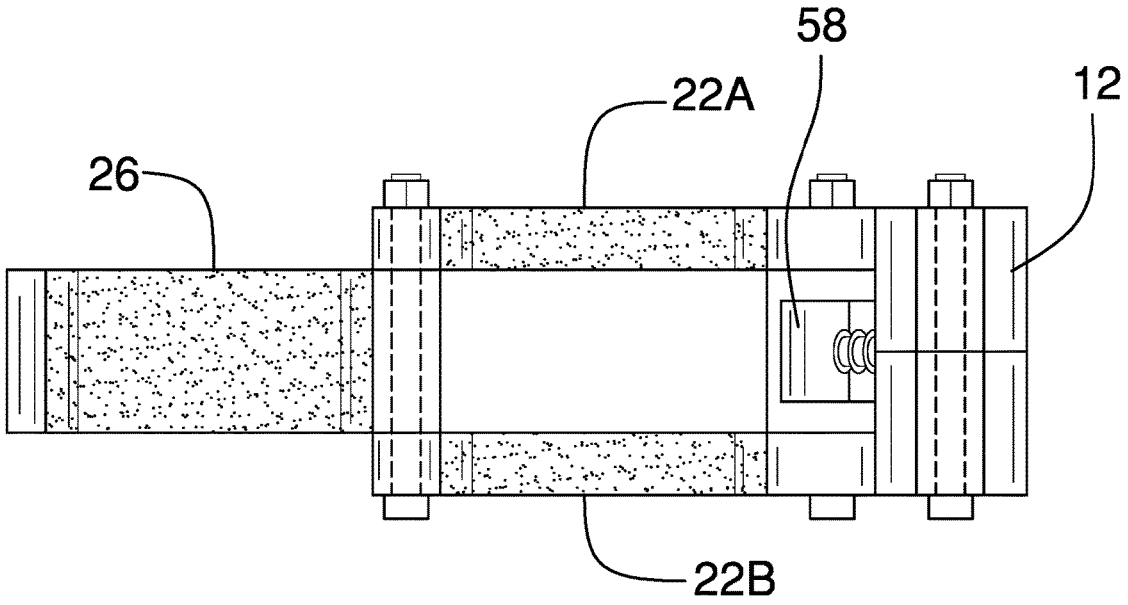
FIG. 3 is a top view of an embodiment of the disclosure.
Figure 4:
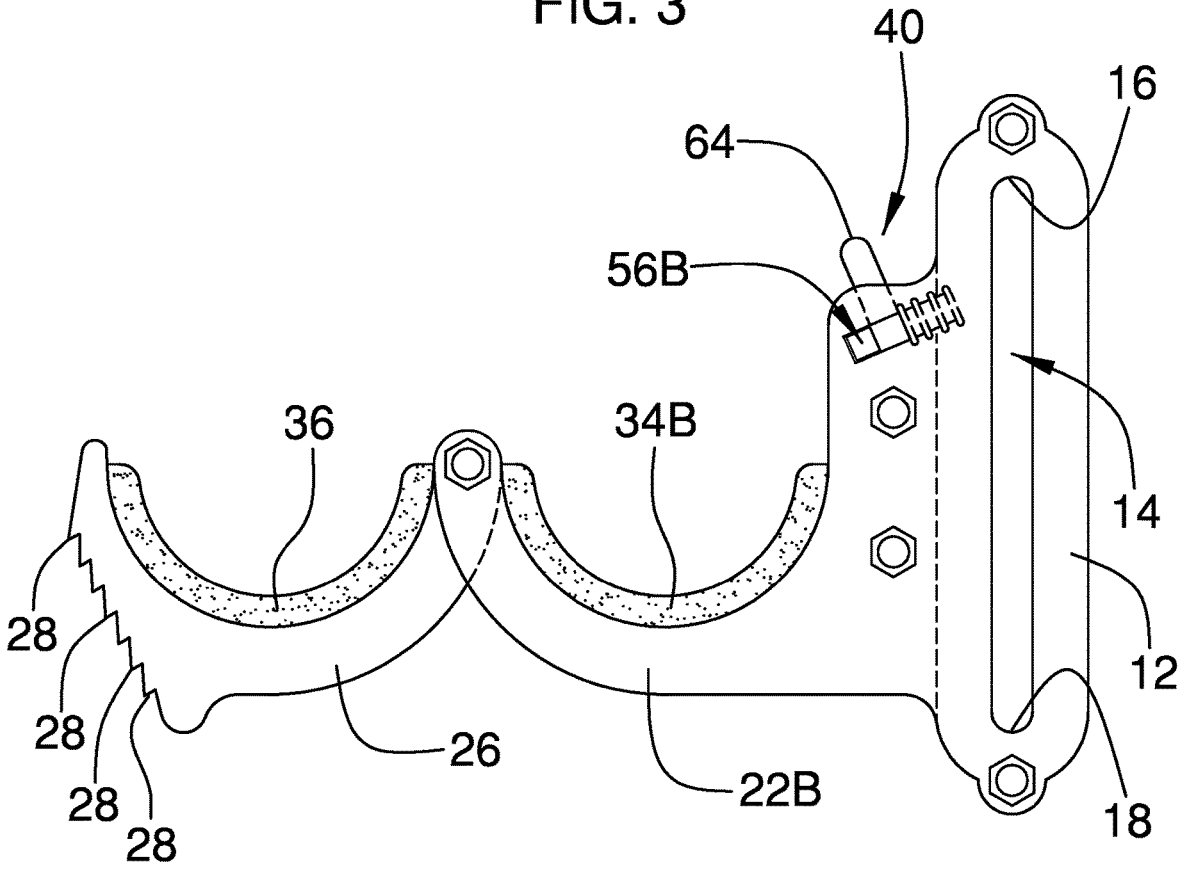
FIG. 4 is a side view of an embodiment of the disclosure.
Figure 5:
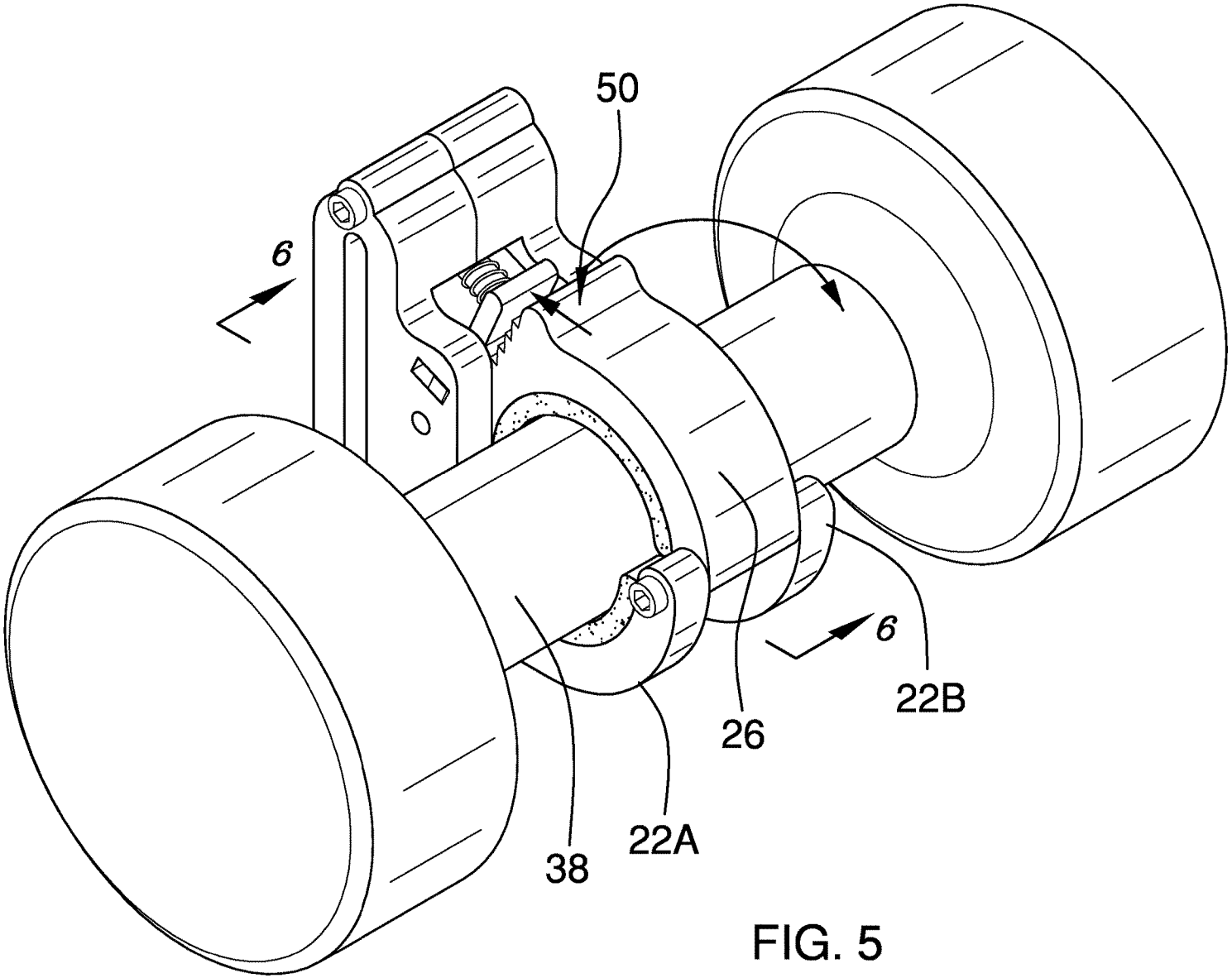
FIG. 5 is a top front side perspective view of an embodiment of the disclosure in use.
Figure 6:
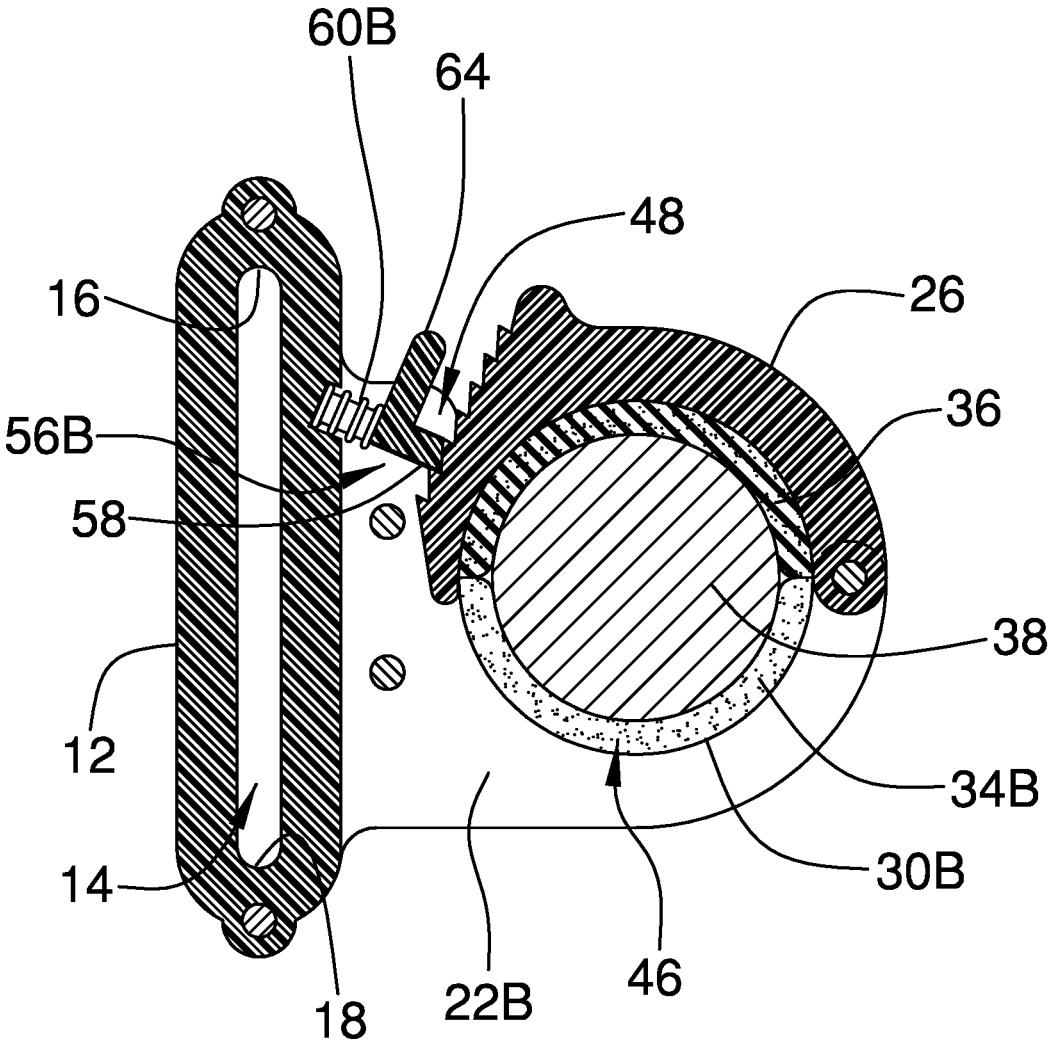
FIG. 6 is a cross-sectional view of an embodiment of the disclosure taken along line 6-6 of FIG. 5.
Figure 7:
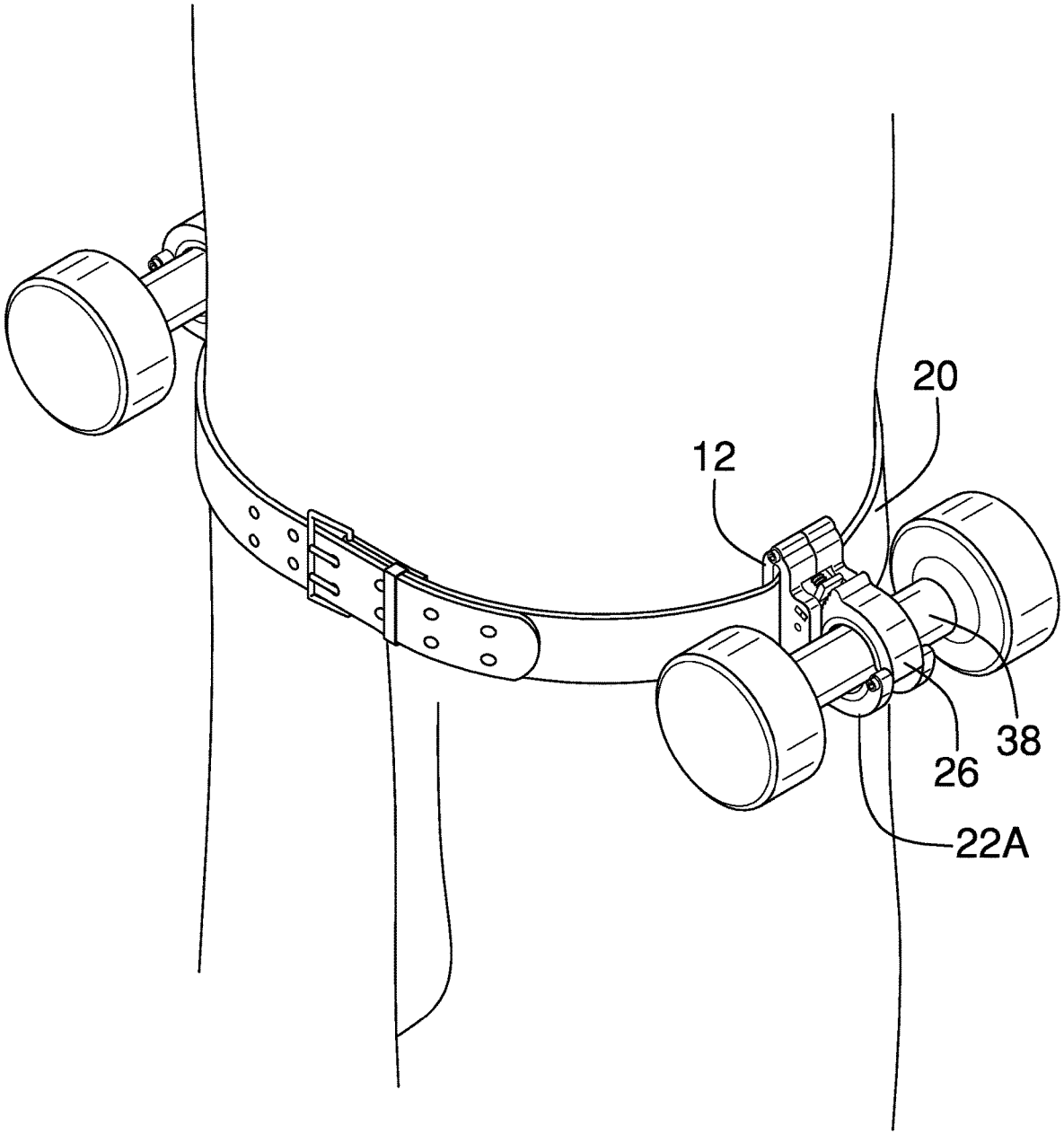
FIG. 7 is a top front side perspective view of an embodiment of the disclosure in use.
Figure 8:
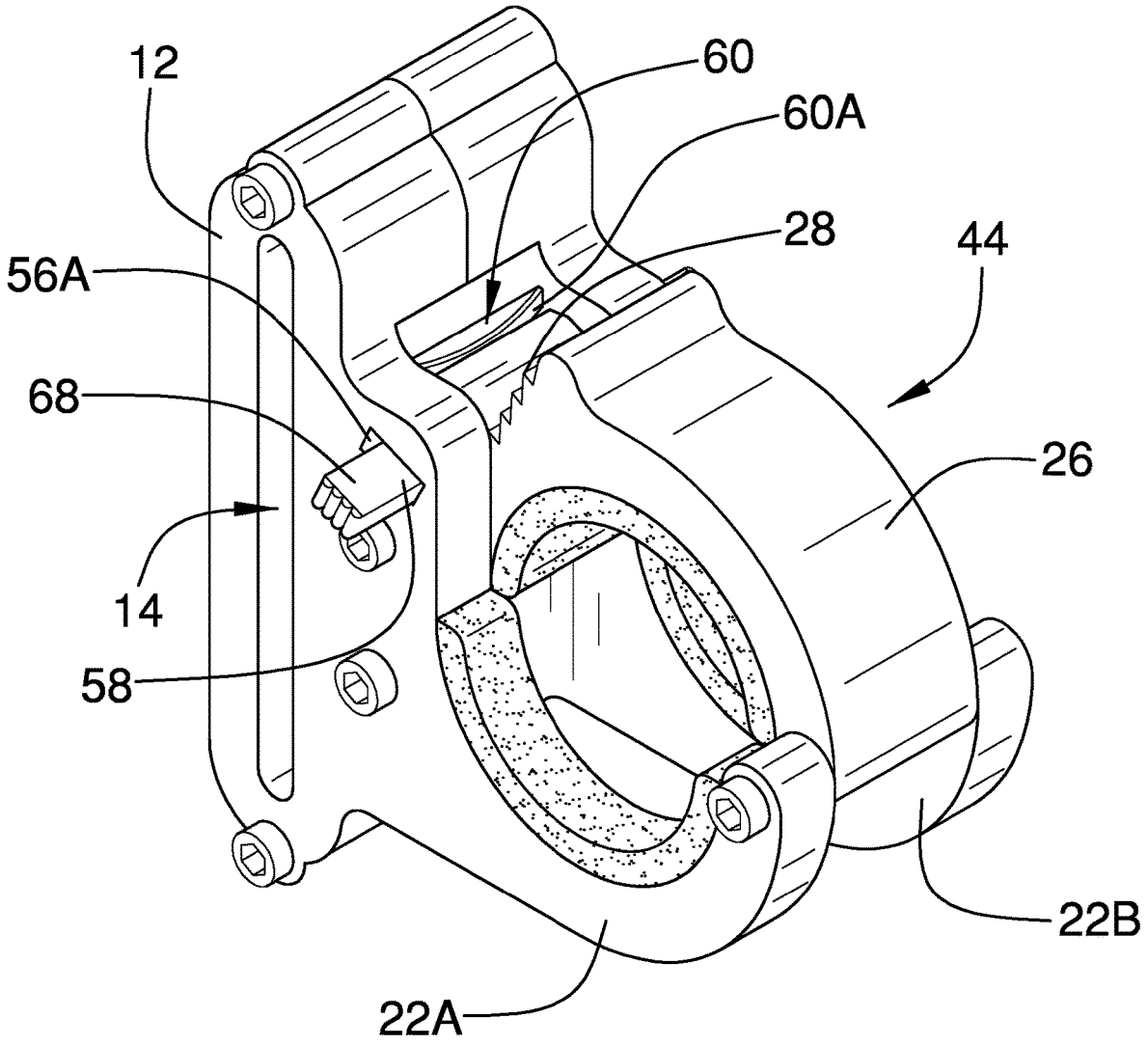
FIG. 8 is a top front side perspective view of an alternative embodiment of the disclosure.
Figure 9:
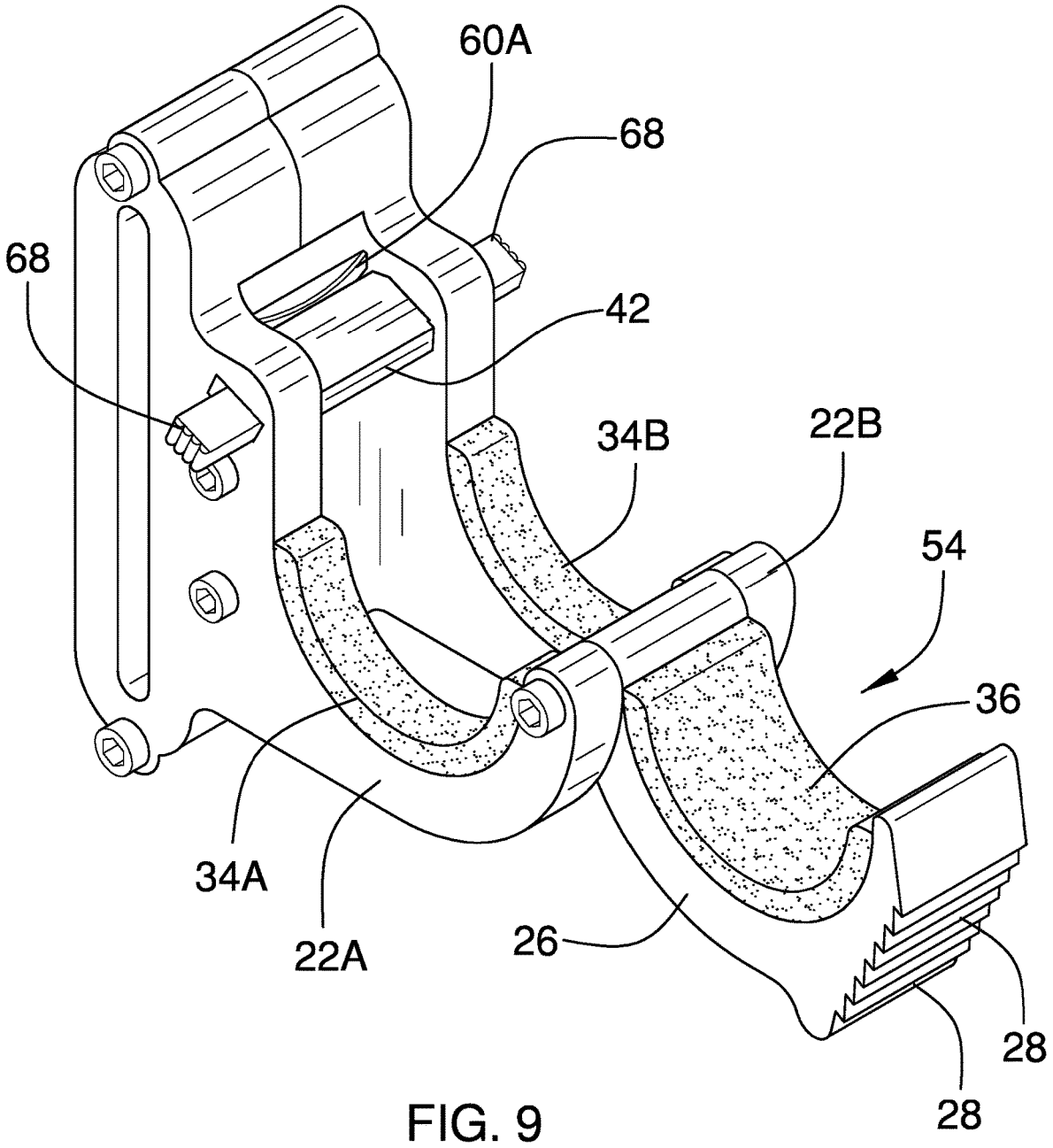
FIG. 9 is a top front side perspective view of the alternative embodiment of the disclosure in an open position.
Figure 10:
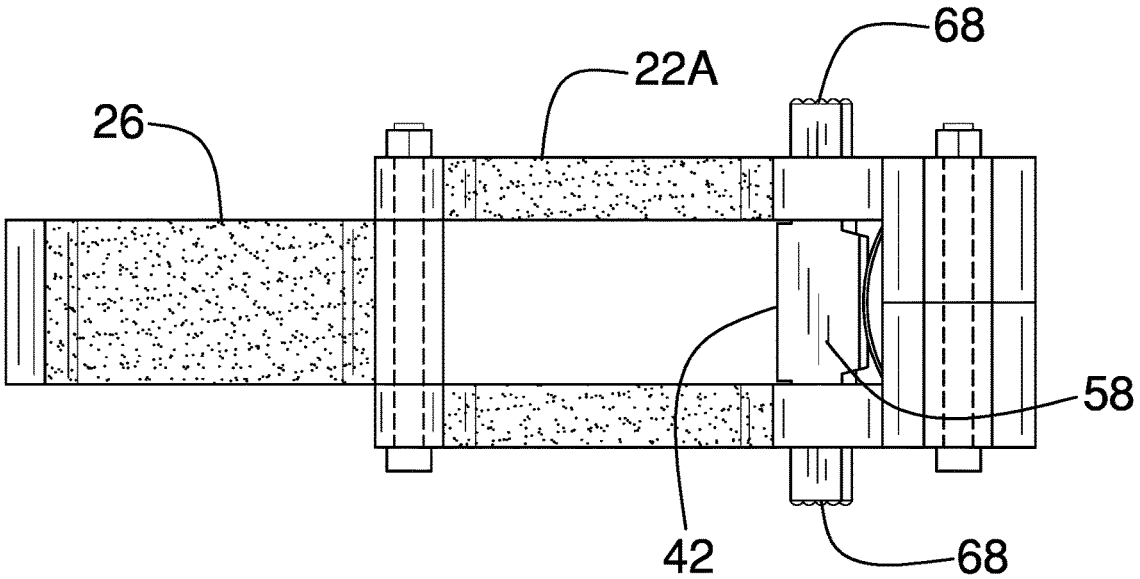
FIG. 10 is a top view of the alternative embodiment of the disclosure in an open position.
Figure 11:
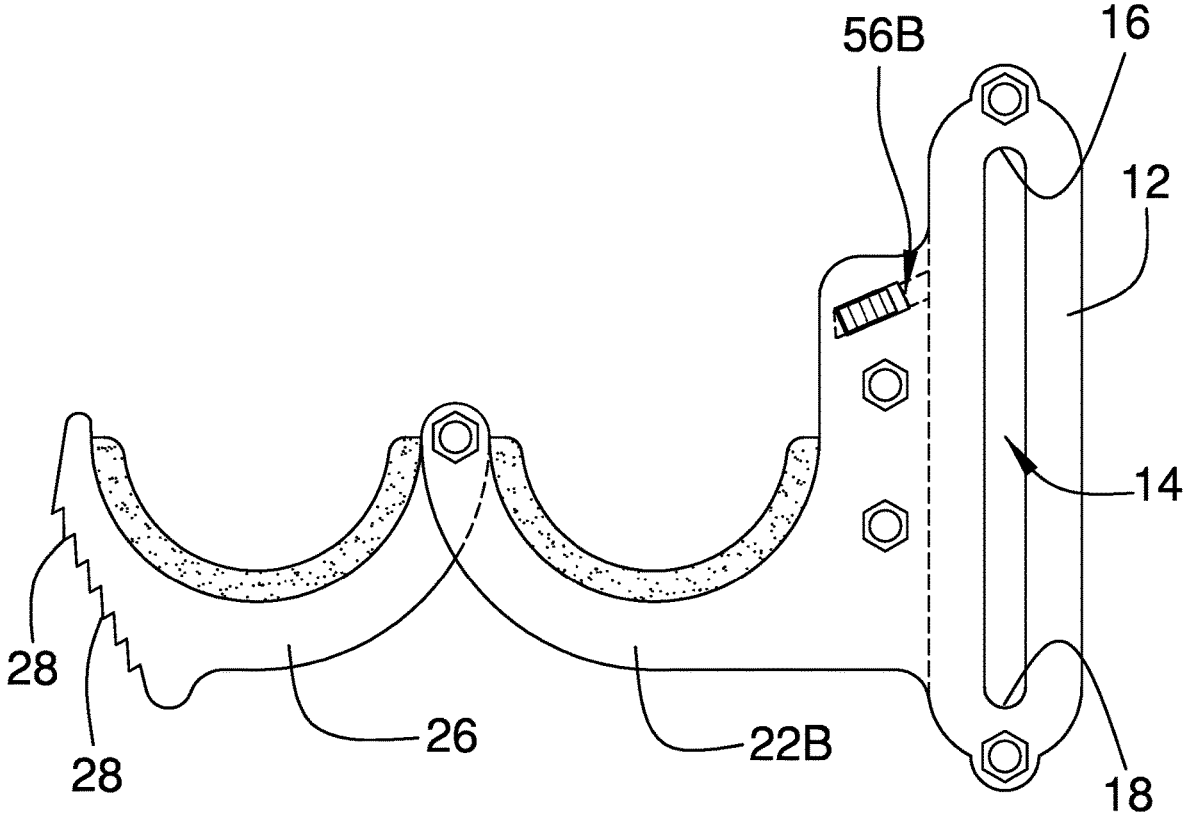
FIG. 11 is a side view of the alternative embodiment of the disclosure in an open position.

With reference now to the drawings, and in particular to FIGS. 1 through 11 thereof, a new clip device embodying the principles and concepts of an embodiment of the disclosure and generally designated by the reference numeral 10 will be described.

As best illustrated in FIGS. 1 through 11, the dumbbell clip device 10 generally comprises a base 12. A conduit 14 extends through the base 12. The conduit 14 is elongated between a top 16 of the conduit 14 and a bottom 18 of the conduit 14 such that the conduit 14 is configured to receive a weight lifting belt 20 through the conduit 14. Thus, the base 12 is coupled to the weight lifting belt 20. The base 20 can be sized and a length of the conduit 14 between the top 16 and the bottom 18 sized to fit and correspond to various sizes of weight lifting belts 20.

A bottom jaw 22 extends from the base 12. The bottom jaw 22 is in a fixed position relative to the base 12. The bottom jaw 22 is one of a pair of bottom jaws 22A,22B. The pair of bottom jaws 22A,22B is spaced and parallel such that the pair of bottom jaws 22A,22B define a slot 24 between the pair of bottom jaws 22A,22B. A top jaw 26 is pivotally coupled to the bottom jaws 22A,22B. The top jaw 26 is pivotally coupled between the pair of bottom jaws 22A,22B within the slot 24. A tooth 28 is positioned on the top jaw 26. While a single tooth may be provided, the tooth 28 may be one of a series of teeth 28 aligned along the top jaw 26.

Each bottom jaw 22A,22B has a top surface 30A,30B facing the top jaw 26. The top surface 30A,30B of each bottom jaw 22A,22B is concave. The top jaw 26 has a bottom surface 32 facing the bottom jaws 22A,22B. The bottom surface 32 of the top jaw 26 is concave. Each bottom jaw 22A,22B may have a respective bottom jaw pad 34A, 34B coupled to and extending along the respective top surface 30A,30B of the bottom jaws 22A,22B. Similarly, a top jaw pad 36 is coupled to and extends along the bottom surface 32 facing the bottom jaws 22A,22B.

An engagement 40 is coupled to the base 12. The engagement 40 is positioned within the slot 24 when there are two bottom jaws 22A,22B. The engagement 40 has a locking edge 42 positioned to engage the tooth 28 or a selectable one of the teeth 28 on the top jaw 26. Thus, the top jaw 26 is secured in a closed position 44 forming a closed loop 46 with the bottom jaw 22 or bottom jaws 22A,22B. The closed loop 46 is configured for engaging and holding a dumbbell 38 on the weight lifting belt 20. Each of the teeth 28 is selectively engageable by the engagement 40 such that a size of the closed loop 46 is adjustable by engaging a selectable one of the teeth 28 along the top jaw 26. The engagement 40 is slidable relative to the base 12. The engagement 40 is movable between an engagement position 48 urging the locking edge 42 of the engagement 40 into contact with the top jaw 26 and a disengagement position 50 moving the locking edge 42 of the engagement 40 out of engagement with the tooth 28 or selected one of the plurality of teeth 28. The top jaw 26 is pivotable into an open position 54 relative to the bottom jaw 22 or bottom jaws 22A,22B.

When provided with a pair of bottom jaws 22A,22B, each of a pair of slits 56A,56B is positioned within an associated one of the bottom jaws 22A,22B. The slits 56A,56B are aligned across the slot 24 between the bottom jaws 22A, 22B. The engagement 40 comprises a flange 58 extending across the slot 24 and through each of the slits 56A,56B. Generally, a spring 60 is positioned between the base 12 and the flange 58 of the engagement 40. The spring 60 urges the flange 58 of the engagement 40 away from the base 12 such that the locking edge 42 is urged into contact with the top jaw 26.

In one embodiment, the engagement 40 has a release lever 64 extending perpendicularly from the flange 58. The release lever 64 extends up through the slot 24 to be positioned accessible to a finger or thumb of a user to move the release lever 64 and flange 58 to disengage the locking edge 42. The spring 60 is a compression spring 60A. The release lever 64 abuts the compression spring 60A.

In another embodiment, the flange 58 of the engagement 40 has a length greater than a width between respective outer surfaces 66A,66B of the bottom jaws 22A,22B. Thus, end portions 68 of the flange 58 extend outwardly from each of the outer surfaces 66A,66B of the bottom jaws 22A,22B. The spring 60 is a leaf spring 60B. The leaf spring 60B abuts the flange 58.

In use, the base 12 is attached to the weight lifting belt 20 by insertion of the weight lifting belt 20 through the conduit 14. The top jaw 26 is opened to allow positioning of the dumbbell 38 on the lower jaws 22A,22B. The top jaw 26 is then moved to the closed position 44 forming the closed loop 46 around a handle of the dumbbell 38. This secures the dumbbell 38 to the weight lifting belt 20. Manipulation of the engagement allows for disengagement of the top jaw 26 to allow the dumbbell 38 to be removed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A dumbbell clip device comprising:

a base;

a conduit extending through said base, said conduit being elongated between a top of said conduit and a bottom of said conduit such that said conduit is configured to receive a weight lifting belt through said conduit whereby said base is coupled to the weight lifting belt;

a bottom jaw extending from said base, said bottom jaw being in a fixed position relative to said base;

a top jaw being pivotally coupled to said bottom jaw;

a tooth positioned on said top jaw; and an engagement coupled to said base, said engagement having a locking edge being positioned to engage said tooth on said top jaw whereby said top jaw is secured in a closed position forming a closed loop with said bottom jaw wherein said closed loop is configured for engaging and holding a dumbbell on the weight lifting belt.

2. The dumbbell clip device of claim 1, further comprising said bottom jaw having a top surface facing said top jaw, said top surface of said bottom jaw being concave.

3. The dumbbell clip device of claim 2, further comprising a bottom jaw pad coupled to and extending along said top surface of said bottom jaw.

4. The dumbbell clip device of claim 1, further comprising said top jaw having a bottom surface facing said bottom jaw, said bottom surface of said top jaw being concave.

5. The dumbbell clip device of claim 4, further comprising a top jaw pad being coupled to and extending along said bottom surface facing said bottom jaw.

6. The dumbbell clip device of claim 1, further comprising said bottom jaw being one of a pair of bottom jaws, said pair of bottom jaws being spaced and parallel such that said pair of bottom jaws define a slot between said pair of bottom jaws, said top jaw being pivotally coupled between said pair of bottom jaws within said slot, said engagement being positioned within said slot.

7. The dumbbell clip device of claim 6, further comprising:

a pair of slits, each slit being positioned within an associated bottom jaw of said pair of bottom jaws, said slits being aligned across said slot between said bottom jaws;

said engagement comprising a flange extending across said slot and through each of said slits; and a spring positioned between said base and said flange of said engagement, said spring urging said flange of said engagement away from said base such that said locking edge is urged into contact with said top jaw.

8. The dumbbell clip device of claim 7, further comprising:

said engagement having a release lever extending perpendicularly from said flange; and said spring being a compression spring, said release lever abutting said compression spring.

9. The dumbbell clip device of claim 7, further comprising:

said flange of said engagement having a length greater than a width between respective outer surface of said bottom jaws wherein end portions of said flange extend outwardly from each of said outer surfaces of said bottom jaws; and said spring being a leaf spring, said leaf spring abutting said flange.

10. The dumbbell clip device of claim 9, further comprising opposite ends of said flange each having a respective plurality of ridges.

11. The dumbbell clip device of claim 1, further comprising said tooth being one of a series of teeth aligned along said top jaw, each of said teeth being selectively engageable by said engagement such that a size of said closed loop is adjustable by engaging a selectable one of said teeth along said top jaw.

12. The dumbbell clip device of claim 1, further comprising:

said engagement being slidable relative to said base, said engagement being movable between an engagement position urging said locking edge of said engagement into contact with said top jaw and a disengagement position moving said locking edge of said engagement out of engagement with said tooth wherein said top jaw is pivotable into an open position relative to said bottom jaw; and a compression spring coupled to said base, said compression spring urging said locking edge of said engagement towards said top jaw.

13. A dumbbell clip device comprising:

a base;

a conduit extending through said base, said conduit being elongated between a top of said conduit and a bottom of said conduit such that said conduit is configured to receive a weight lifting belt through said conduit whereby said base is coupled to the weight lifting belt;

a bottom jaw extending from said base, said bottom jaw being in a fixed position relative to said base;

a top jaw being pivotally coupled to said bottom jaw;

a tooth positioned on said top jaw;

said bottom jaw having a top surface facing said top jaw, said top surface of said bottom jaw being concave, said top jaw having a bottom surface facing said bottom jaw, said bottom surface of said top jaw being concave;

a bottom jaw pad coupled to and extending along said top surface of said bottom jaw;

a top jaw pad being coupled to and extending along said bottom surface facing said bottom jaw;

an engagement coupled to said base, said engagement having a locking edge being positioned to engage said tooth on said top jaw whereby said top jaw is secured in a closed position forming a closed loop with said bottom jaw wherein said closed loop is configured for engaging and holding a dumbbell on the weight lifting belt, said engagement being slidable relative to said base, said engagement being movable between an engagement position urging said locking edge of said engagement into contact with said top jaw and a disengagement position moving said locking edge of said engagement out of engagement with said tooth wherein said top jaw is pivotable into an open position relative to said bottom jaw;

said bottom jaw being one of a pair of bottom jaws, said pair of bottom jaws being spaced and parallel such that said pair of bottom jaws define a slot between said pair of bottom jaws, said top jaw being pivotally coupled between said pair of bottom jaws within said slot, said engagement being positioned within said slot;

a pair of slits, each slit being positioned within an associated bottom jaw of said pair of bottom jaws, said slits being aligned across said slot between said bottom jaws, said engagement comprising a flange extending across said slot and through each of said slits;

a spring positioned between said base and said flange of said engagement, said spring urging said flange of said engagement away from said base such that said locking edge is urged into contact with said top jaw;

said tooth being one of a series of teeth aligned along said top jaw, each of said teeth being selectively engageable by said engagement such that a size of said closed loop is adjustable by engaging a selectable one of said teeth along said top jaw.

14. The dumbbell clip device of claim 13, further comprising:

said engagement having a release lever extending perpendicularly from said flange; and said spring being a compression spring, said release lever abutting said compression spring.

15. The dumbbell clip device of claim 13, further comprising:

said flange of said engagement having a length greater than a width between respective outer surface of said bottom jaws wherein end portions of said flange extend outwardly from each of said outer surfaces of said bottom jaws; and said spring being a leaf spring, said leaf spring abutting said flange.

* * * * *